US006313793B1

(12) United States Patent
Brown et al.

(10) Patent No.: US 6,313,793 B1
(45) Date of Patent: Nov. 6, 2001

(54) COMPACT, HIGH-POWER MICROWAVE PHASE SHIFTER

(75) Inventors: Kenneth W. Brown, Yucaipa; Vincent Giancola, Chino, both of CA (US)

(73) Assignee: Raytheon Company, MA (US)

( * ) Notice: Subject to any disclaimer, the term of this patent is extended or adjusted under 35 U.S.C. 154(b) by 0 days.

(21) Appl. No.: 09/479,169

(22) Filed: Jan. 7, 2000

(51) Int. Cl.[7] ..... H01Q 3/02; H01Q 3/12; H01Q 13/00

(52) U.S. Cl. ..... 342/374; 343/778

(58) Field of Search ..... 342/368, 374, 342/375; 343/776, 777, 778, 779; 333/108, 157, 159, 162

(56) References Cited

U.S. PATENT DOCUMENTS 5,926,589 * 7/1999 Gaeta ..... 385/16

* cited by examiner

*Primary Examiner*—Thomas H. Tarcza
*Assistant Examiner*—Fred H. Mull

(57) ABSTRACT

A phased array antenna including at least one configurable phase shifter. The configurable phase shifter includes a U-shaped primary waveguide section and multiple switchable waveguide U-shaped sections disposed within the primary section. The switchable waveguide sections include a plunger in the U-shaped waveguide section and one or more solenoids attached to the plunger, driving the plunger in and out such that the switches can be actuated in less than 100 milliseconds. The plunger and the switchable waveguide section are shaped such that the waveguide height is constant in the U-shaped waveguide section when the switch is closed and constant in the primary waveguide section when the switch is open, thereby minimizing return loss. The U-shaped primary waveguide section includes an input port and an output port at opposite sides. A radiating slot is located at the bottom face of the U-shaped primary waveguide section. The radiating slot may be formed in a detachable plate attached to the bottom the U-shaped primary waveguide section. Further, multiple one configurable phase shifters may be cascaded to form a traveling wave phased array antenna.

22 Claims, 6 Drawing Sheets

COMPACT, HIGH-POWER MICROWAVE PHASE SHIFTER

BACKGROUND OF THE INVENTION

1. Field of the Invention

The present invention relates to phased array antennas. More specifically, the present invention relates to digital phase shifters for high power radio frequency phased array antennas.

2. Description of the Related Art

An integral component of a wide-scan phased array antenna is a compact phase shifter. However, most state of the art phased array antennas for radar applications require phase shifters that switch in the sub-millisecond range.

In what is commonly referred to as a digital phase shifter, the length of the phase shifter is configurable from different lengths or sections of waveguides that can be selectively switched in or out. Typically, the various sections are lengths that are proportional to each other by factors of 2. For example, one length may be twice as long as another, second length. Yet a third length may be twice as long as the second length and so on. Thus, the various sections may be selectively switched in or out, thereby being combined to change the phase, incrementally. As the effective length of the overall phase shifter is changed, the phase changes proportionally.

There are few current applications for phased array antennas using slower phase shifters, i.e., with switching in the millisecond range. However, there are current directed energy system development programs that require a phased array antenna capable of radiating extremely high power. Further, directed energy systems do not require high speed phase shifters. Unfortunately, there are no compact phase shifters currently available for these applications.

Presently, only a ferrite phase shifter is available that is capable of handling these high power levels. However, this ferrite phase shifter is large, heavy, requires liquid cooling and is very expensive.

Thus, there is a need for a compact, high-power microwave phase shifter for use with phased array antennas in high power directed energy systems. There is also a need that such a high-power microwave phase shifter be lightweight and inexpensive.

SUMMARY OF THE INVENTION

The need in the art is addressed by the phased array antenna of the present invention. The inventive antenna includes at least one configurable phase shifter. The configurable phase shifter includes a primary waveguide section and multiple switchable waveguide sections disposed within the primary section. The switchable waveguide sections are selectively connectable to the primary waveguide section.

In a specific implementation, the switchable waveguide sections include a U-shaped waveguide section, a plunger in the U-shaped waveguide section and one or more solenoids attached to the plunger. The solenoids drive the plunger in and out such that the switchable waveguide sections can be actuated in less than 100 milliseconds. The plunger and the switchable waveguide section are shaped such that the waveguide height is constant in the U-shaped waveguide section when the switch is closed and constant in the primary waveguide section when the switch is open, thereby minimizing return loss. The U-shaped primary waveguide section includes an input port and an output port at opposite sides. A radiating slot is located at the bottom face of the U-shaped primary waveguide section. The radiating slot may be formed in a detachable plate attached to the bottom the U-shaped primary waveguide section. Further, multiple configurable phase shifters may be cascaded to form a traveling wave phased array antenna.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
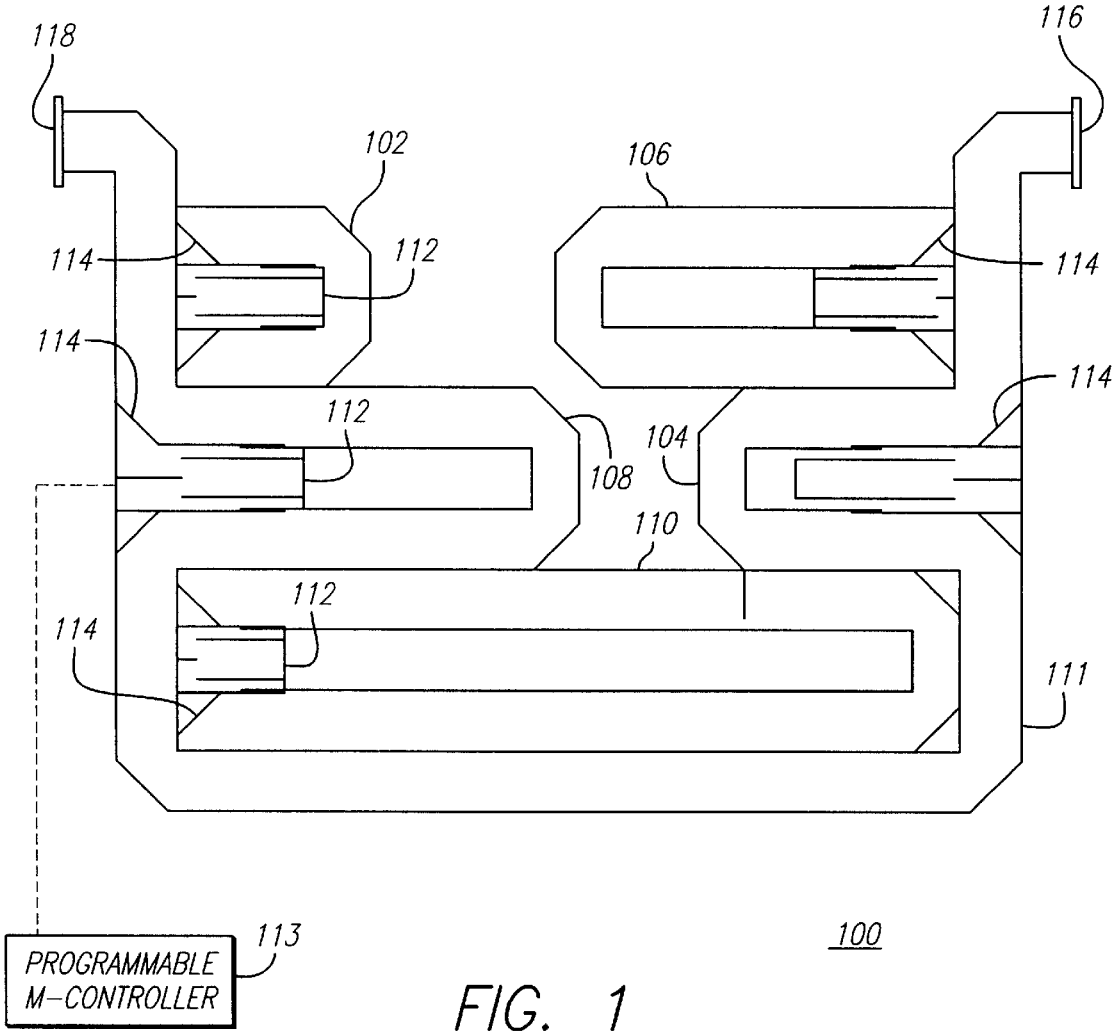
FIG. 1 is a layout of a five-section phase shifter constructed in accordance with the teachings of the present invention.

FIG. 1 shows a cross-sectional view of an exemplary embodiment of a digital phase shifter 100 constructed in accordance with the teachings of the present invention. The digital phase shifter 100 includes five switchable U-shaped waveguide sections 102, 104, 106, 108 and 110 of various path lengths disposed within a primary waveguide section 111. The primary waveguide section 111 is also U-shaped. Each switchable section 102, 104, 106, 108, 110 includes a solenoid actuator 112 that positions a plunger 114. The plunger 114 switches the switchable section 102, 104, 106, 108, 110 in or out. The primary waveguide section 111, switchable sections 102, 104, 106, 108, 110 and plunger 114 are of a suitably conductive material such as aluminum.

Microwave energy enters primary section 111 at input port 116 and exits at exit port 118. As referred to herein, waveguide height and width are the distances between waveguide internal walls, i.e., perpendicular to the radio frequency (RF) energy path or line of travel, and waveguide length is the distance along the RF path or line of travel.

The phase-shifter 100 shown in the example of FIG. 1 can be configured for 32 different waveguide lengths, each providing one of 32 different phase states. In particular, the phase shifter 100 shown in the example of FIG. 1 is shown with switchable sections 104 and 108 switched-in. This allows the microwave energy entering the digital phase-shifter 100 at input port 116 to pass through the lengths of switched-in sections 104, 108 prior to exiting at port 118. Since switchable sections 102, 106 and 110 are switched out, these switchable sections 102, 106 and 110 are bypassed by microwave energy passing through the phase shifter 100. Each of the mechanical waveguide switches 102, 104, 106, 108 and 110 can be switched in or out in less than 100 milliseconds, thereby reconfiguring the waveguide in a response time acceptable for directed energy system applications. In this regard, a programmable microcontroller 113 or other suitable control electronics well-known to those having ordinary skill in the pertinent art can be employed to generate control signals as required to actuate the solenoid actuator 112 of each of the mechanical waveguide switches 102, 104, 106, 108 and 110.

It should be noted that although the exemplary embodiment of FIG. 1 shows five different sized U-shaped sections, 102, 104, 106, 108 and 110, each related to others by a factor of two, this is for example only and not intended as a limitation. The individual section lengths 102, 104, 106, 108, 110 may be chosen to have a length that is suitable for the particular application. For example, all sections 102, 104, 106, 108 and 110 may be the same length or, two sections may be of a first length and three may be of a second. Further, the primary section 111 and the switchable sections may be other than U-shaped and any number of sections may be included without departing from the invention.

Figure 2A:
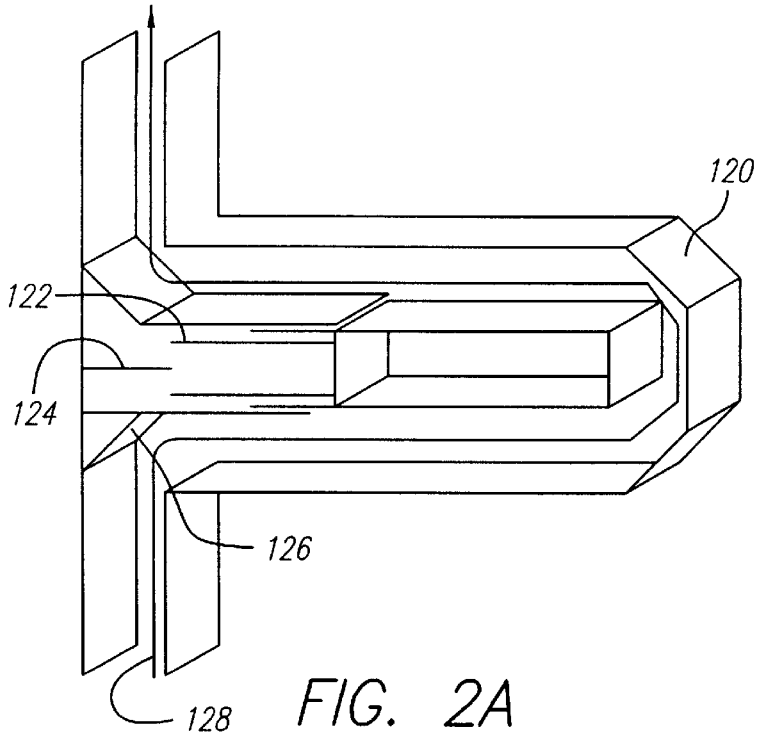
FIGS. 2A and 2B show a preferred embodiment of a phase shifter constructed in accordance with the teachings of the present invention in actuated and non-actuated switch position positions, respectively.
Figure 2B:
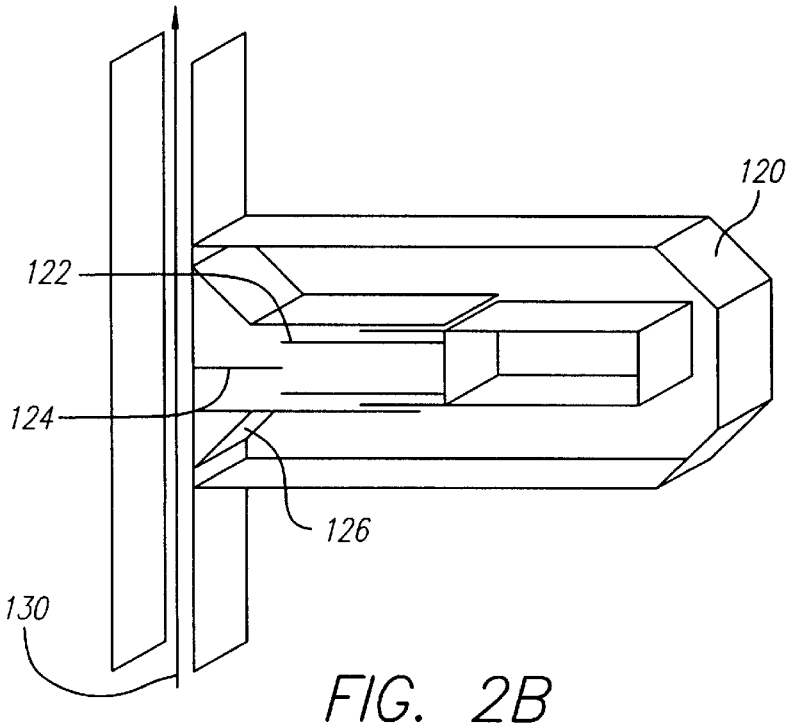

FIGS. 2A–B depict cross-sectional views of another preferred embodiment switchable section 120. Although, as in the example of FIG. 1, a single solenoid actuator 112 is sufficient, in the switchable section 120 of this example, two solenoid actuators 122, 124 drive a plunger 126. The RF energy path of travel is represented by arrows 128, 130.

Two solenoids 122, 124 (or more) may be used to reduce the size of the solenoid required, allowing smaller solenoids 122, 124 to be substituted for larger ones 112. Further, when the plunger 126 is large and unwieldy, using a single solenoid 112 may result in unwanted binding or wedging. Thus, two solenoids 122, 124 provide additional balance to move a large plunger 126 back and forth smoothly, switching the switchable section 120 in and out without the plunger 126 binding or wedging.

Further, as can be seen from FIGS. 2A and 2B, the plunger 126 and the corresponding surrounding area of switchable section 120 are uniquely designed such that opposing surfaces mirror each other when the plunger 126 is locked in either the switch's closed position of FIG. 2A or in its open position of FIG. 2B. Thus, the plunger 126 and the surrounding switchable area of section 120 are shaped such that a constant waveguide height is maintained whether the switch is in its closed (actuated) position of FIG. 2A or in its open (non-actuated) position of FIG. 2B. As a result, microwave energy passing along the RF paths 128, 130 and passing through the switchable section 120 exhibits very little loss.

Figure 3:
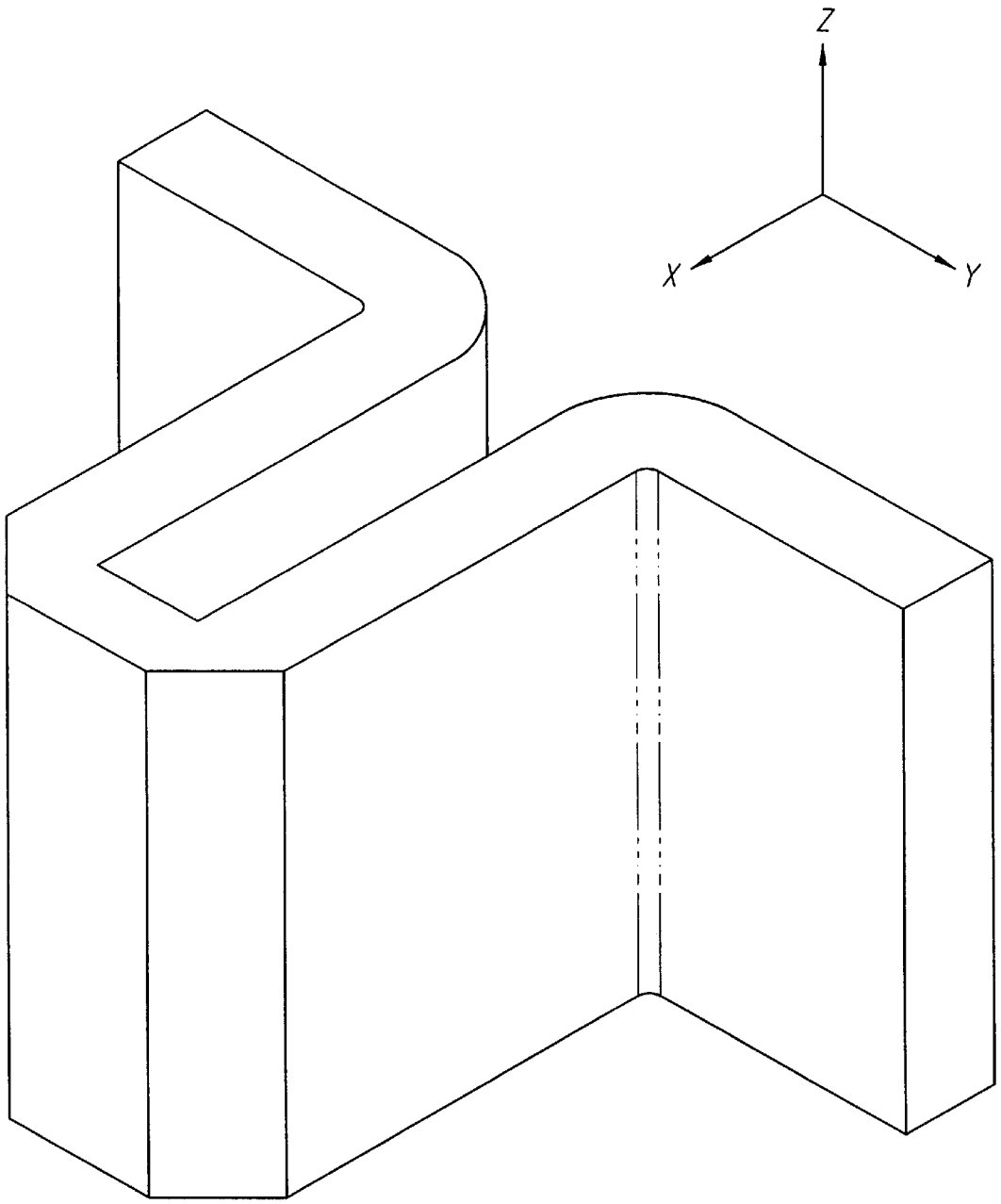
FIG. 3 is a finite element computer model of a preferred embodiment of a switch junction constructed in accordance with the teachings of the present invention.

FIG. 3 is a full-wave analysis model representation of the exemplary switchable section 120 modeled in the closed position of FIG. 2A using a finite element computer modeling program.

Figure 4:
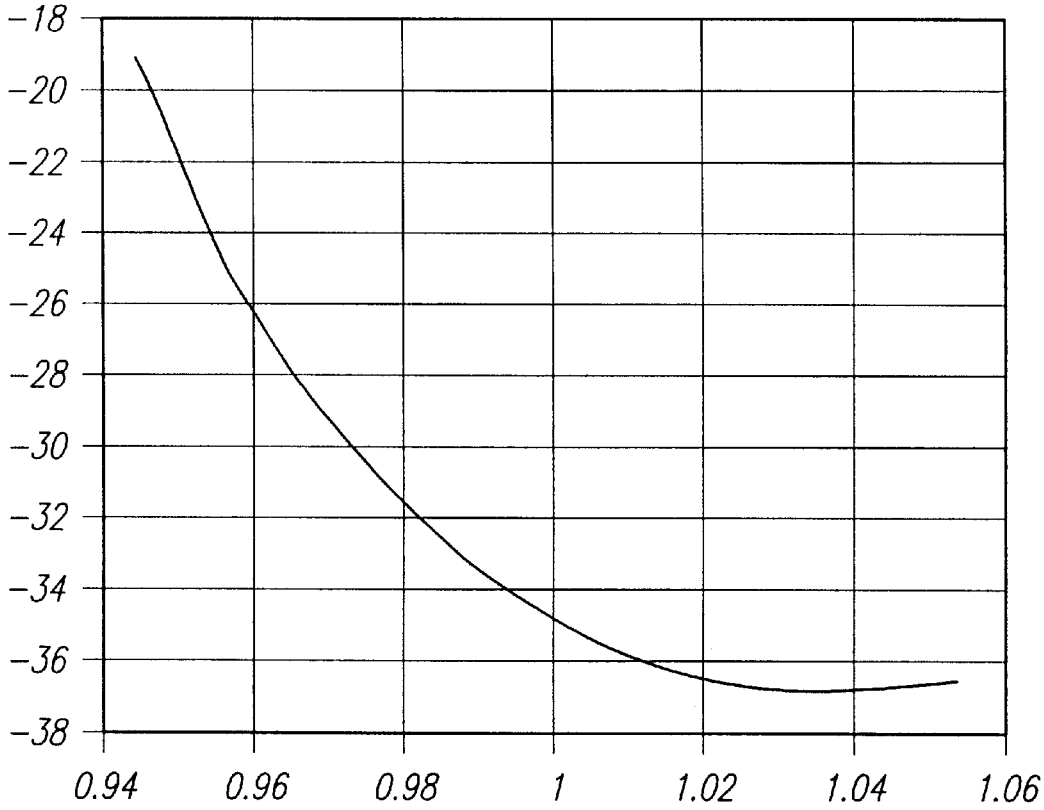
FIG. 4 shows the predicted return loss of a waveguide switch junction constructed in accordance with the teachings of the present invention.

FIG. 4 represents worst case return loss analysis for the closed position of the switchable section 120 of FIG. 2A, comparing return loss against operating frequency (F) normalized to design frequency (F0). Accordingly, as can be seen from FIG. 4, at the switch 120 design frequency (F/F0=1) the power reflected from the switched plunger 126 is below −35 dB. As can further be seen from FIG. 4, the switchable section of FIGS. 2A–B has a broad bandwidth. It should be noted that since the closed position of FIG. 2A is the worst case position for return loss, the open position of FIG. 2B has much better return loss, i.e., well below −36dB.

Figure 5:
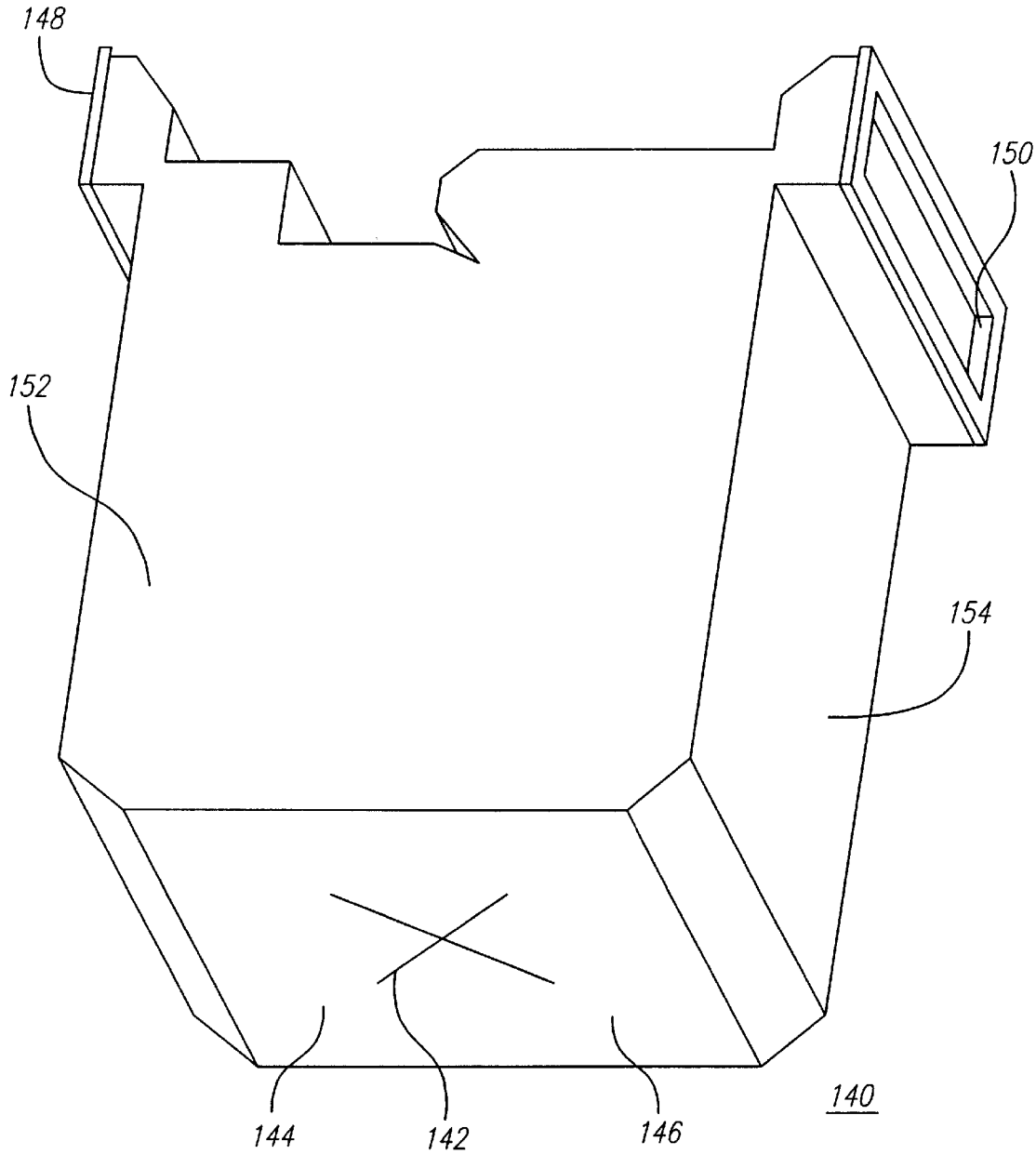
FIG. 5 shows a three dimensional view of a five-section phase shifter constructed in accordance with the teachings of the present invention with a radiating slot.

FIG. 5 shows a three-dimensional view of a phase-shifter 140, similar to the example of FIG. 1. The waveguide 140 of this example has an aspect ratio of approximately 9:1, width to height, as compared to typical prior art waveguides that have a 2:1 width to height ratio. Further, in this example, a radiating slot 142 is machined into the bottom plate 144 of the phase shifter 140. The radiating slot 142 is a cross-slot that provides circular polarization of radiation emanating therefrom with very little internal return loss experienced in the phase-shifter waveguide 140. Optionally, the slot 142 can be in a removable plate 146 attached to the phase shifter 140 to allow the slot 142 configuration to be changed easily. The input port 148 and output port 150 are located at the same height on opposite sides 152, and 154, respectively, for easy attachment to additional phase shifters 140, cascading multiple phase shifters 140.

Figure 6:
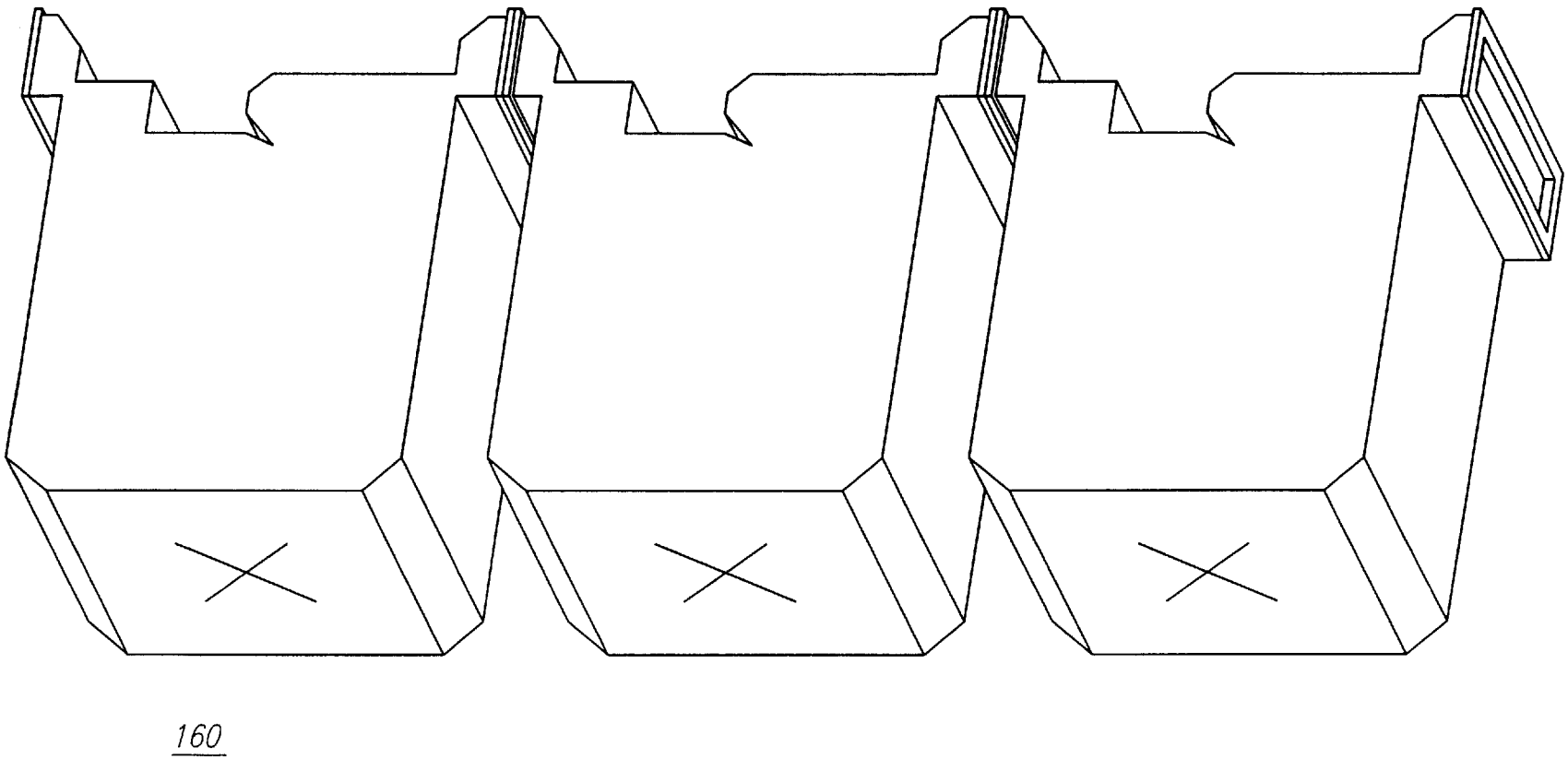
FIG. 6 shows a preferred embodiment of a phased array antenna constructed in accordance with the teachings of the present invention comprised of cascaded phase shifters.

FIG. 6 shows a traveling-wave phased array antenna 160 formed by cascading multiple phase shifters 140. In the example of FIG. 6, three phase shifters 140 are cascaded or daisy chained together to form the three-element linear antenna array 160. Thus, because of location of the input port 148 and output port 150 of each phase shifter 140, any number of phase shifters 140 may be cascaded as desired. Further, although nearly any waveguide aspect ratio may be acceptable, the size of the phase shifter 140 is reduced, significantly, by using a high aspect ratio waveguide, 10:1 width-height ratio as in the example of FIGS. 5 and 6.

Thus, the present invention is an extremely compact, high-power, electro-mechanical phase shifter. Further, a radiating slot may be included on the phase shifter itself, further reducing the volume of the phased array antenna.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

Accordingly,

What is claimed is:

1. A phased array antenna including at least one configurable phase shifter, the configurable phase shifter comprising:

a primary waveguide section and a plurality of switchable waveguide sections disposed within and selectively connectable to the primary waveguide section, wherein the primary waveguide section and the switchable waveguide sections are U-shaped and each of the switchable waveguide sections include:

a plunger movably disposed within the U-shaped waveguide section and at least one solenoid attached to the plunger.

2. The phased array antenna of claim 1 wherein at least one solenoid is two solenoids.

3. The phased array antenna of claim 1 wherein the plurality of switchable waveguide sections comprises five switchable sections, a first of the five switchable sections having a first width, a second switchable section having a second width that is twice the first width, a third switchable section having a third width that is twice the second width, a fourth switchable section having a fourth width that is twice the third width, and a fifth switchable section having a fifth width that is twice the fourth width.

4. The phased array antenna of claim 3 wherein the five switchable sections are disposed at selected locations on legs of the U-shaped primary waveguide section.

5. The phased array antenna of claim 1 wherein the plunger and the U-shaped waveguide section of the switchable waveguide sections are shaped such that return loss is minimized.

6. The phased array antenna of claim 1 wherein the plunger and the U-shaped waveguide section of the switchable waveguide sections are shaped such that the waveguide height is constant in the U-shaped waveguide section when the plunger is disposed in a closed position and constant in the primary waveguide section when the plunger in an open position.

7. The phased array antenna of claim 1 wherein each at least one configurable phase shifter further comprises:

an input port at one side of the U-shaped primary waveguide section and an output port at an opposite side of the U-shaped primary waveguide section, the input port and the output port being located at the same height along opposite sides of the U-shaped primary wave guide section.

8. The phased array antenna of claim 7 wherein each at least one configurable phase shifter further comprises a radiating slot at a bottom face of the U-shaped primary waveguide section.

9. The phased array antenna of claim 8 wherein each at least one configurable phase shifter further comprises a detachable plate attached to the bottom of the U-shaped primary waveguide section, the radiating slot formed in the detachable plate.

10. The phased array antenna of claim 8 wherein each at least one configurable phase shifter has an aspect ratio of at least 9:1.

11. A phased array antenna as in claim 10 wherein the phased array antenna is a traveling wave phased array antenna and at least one configurable phase shifter is a plurality of configurable phase shifters cascaded, input ports being connected to output ports of adjacent the cascaded configurable phase shifters.

12. A phased array antenna as in claim 10 wherein the phased array antenna is a traveling wave phased array antenna and at least one configurable phase shifter is a plurality of configurable phase shifters cascaded, input ports being connected to output ports of adjacent the cascaded configurable phase shifters.

13. A phased array antenna including at least one configurable phase shifter, the configurable phase shifter comprising:

a primary waveguide section, the primary waveguide section being U-shaped; and a plurality of switchable waveguide sections disposed within and selectively connectable to the primary waveguide section, each of the switchable waveguide sections comprising:

a U-shaped waveguide section, a plunger movably disposed within the U-shaped waveguide section, and at least one solenoid attached to the plunger.

14. The phased array antenna of claim 13 wherein the plunger and the U-shaped waveguide section of the switchable waveguide sections are shaped such that the waveguide height is constant in the U-shaped waveguide section when the plunger is disposed in a closed position and constant in the primary waveguide section when the plunger in an open position, whereby return loss is minimized.

15. The phased array antenna of claim 14 wherein each at least one configurable phase shifter further comprises:

an input port at one side of the U-shaped primary waveguide section;

an output port at an opposite side of the U-shaped primary waveguide section, the input port and the output port being located at the same height along opposite sides of the U-shaped primary wave guide section; and a radiating slot at a bottom face of the U-shaped primary waveguide section.

16. The phased array antenna of claim 15 wherein each at least one configurable phase shifter further comprises a detachable plate attached to the bottom of the U-shaped primary waveguide section, the radiating slot formed in the detachable plate.

17. The phased array antenna of claim 16 wherein each at least one configurable phase shifter has an aspect ratio of at least 9:1.

18. A traveling wave phased array antenna including a plurality of configurable phase shifters cascaded, input ports being connected to output ports of adjacent the cascaded configurable phase shifters, each the configurable phase shifter comprising:

a primary waveguide section, the primary waveguide section being U-shaped and comprising:

an input port at one side of the U-shaped primary waveguide section;

an output port at an opposite side of the U-shaped primary waveguide section, the input port and the output port being located at the same height along opposite sides of the U-shaped primary wave guide section; and a radiating slot at a bottom face of the U-shaped primary waveguide section; and, a plurality of switchable waveguide sections disposed within the primary waveguide section, each of the switchable waveguide sections comprising:

a U-shaped waveguide section connected to the primary waveguide section, a plunger movably disposed within the U-shaped waveguide section, the plunger and the U-shaped waveguide section of the switchable waveguide sections are shaped such that the waveguide height is constant in the U-shaped waveguide section when the plunger is disposed in a closed position and constant in the primary waveguide section when the plunger in an open position, whereby return loss is minimized, and at least one solenoid attached to the plunger.

19. The traveling wave phased array antenna of claim 18 wherein each configurable phase shifter further comprises a detachable plate attached to the bottom of the U-shaped primary waveguide section, the radiating slot formed in the detachable plate.

20. A phased array antenna including at least one configurable phase shifter, the configurable phase shifter comprising:

a primary waveguide section; and a plurality of switchable waveguide sections disposed within and selectively connectable to the primary waveguide section, the primary waveguide section and the switchable waveguide sections being U-shaped;

an input port at one side of the U-shaped primary waveguide section;

an output port at an opposite side of the U-shaped primary waveguide section, the input port and the output port being located at the same height along opposite sides of the U-shaped primary wave guide section; and a radiating slot at a bottom face of the U-shaped primary waveguide section.

21. The phased array antenna of claim 20 wherein each at least one configurable phase shifter further comprises a detachable plate attached to the bottom of the U-shaped primary waveguide section, the radiating slot formed in the detachable plate.

22. The phased array antenna of claim 20 wherein each at least one configurable phase shifter has an aspect ratio of at least 9:1.

* * * * *